US005400853A

United States Patent [19]

Wolters

[11] Patent Number: 5,400,853

[45] Date of Patent: Mar. 28, 1995

[54] MODULAR HEATING/COOLING COIL DESIGN AND COIL FLOW CONNECTOR

[76] Inventor: H. Otto Wolters, 18 Essex La., Lincolnshire, Ill. 60069

[21] Appl. No.: 955,032

[22] Filed: Oct. 1, 1992

[51] Int. Cl.[6] ..... F28F 9/26

[52] U.S. Cl. ..... 165/137; 165/144; 165/174; 165/176

[58] Field of Search ..... 165/176, 175, 174, 144, 165/137

[56] References Cited

U.S. PATENT DOCUMENTS 5,095,572 4/1990 Nakaguro ..... 165/176

FOREIGN PATENT DOCUMENTS 725091 9/1942 Germany ..... 165/176
2526581 12/1976 Germany ..... 165/176
2527370 12/1976 Germany ..... 165/176
844660 8/1960 United Kingdom ..... 165/176

*Primary Examiner*—John K. Ford
*Attorney, Agent, or Firm*—Kajane McManus

[57] ABSTRACT

The modular heat exchanger system comprises at least a primary heat exchanger having two parallel manifolds with a chosen plurality of heat exchange tubes running therebetween, the manifolds defining a water pathway therein within which baffles are provided to produce a serpentine path through the manifolds and heat exchange tubes of the exchanger, one of the manifolds being an intake manifold and the other being a return manifold having a terminal return chamber, the chamber feeding into a return tube extending through the manifold and exiting the opposite end thereof, the tube being of smaller diameter than the manifold and creating an annular channel therearound through which liquid flowing through the exchanger is routed. The system further includes a secondary heat exchanger having two parallel manifolds with a chosen plurality of heat exchange tubes running therebetween, the manifolds defining a water pathway therein within which baffles are provided to produce a serpentine path through the manifolds and heat exchange tubes of the exchanger, one of the manifolds being an intake manifold and the other being a return manifold having a terminal return chamber, the chamber feeding into a return tube extending through the manifold and exiting the opposite end thereof, the tube being of smaller diameter than the manifold and creating an annular channel therearound through which liquid flowing through the exchanger is routed, and an intake chamber at the opposite end of the manifold which is joined to the return chamber of the primary exchanger, in a manner where, upon blocking access between the return tube and return chamber of the primary exchanger, liquid from the return chamber of the primary exchanger flows into the intake chamber of the secondary exchanger.

1 Claim, 5 Drawing Sheets

MODULAR HEATING/COOLING COIL DESIGN AND COIL FLOW CONNECTOR

BACKGROUND OF THE INVENTION

1. Field of the Invention

The present invention relates to a modular heat exchanger system which comprises a plurality of interconnectable heat exchanger modules to provide a system which can be of any chosen number of modules, such system being used in a variety of chemical metal finishing and similar applications.

2. Description of the Prior Art

Heretofore various heat exchangers have been proposed. Examples of such proposed embodiments may be found in the following patents:

The Spearing UK Patent No. 844,660 discloses an improved and simplified heat exchanger header.

The German Offenlegungsschrift No. 25 26 581 discloses installation of a baffle plate in a lower distribution pipe of a radiator, separating ascending and descending pipe pathway.

The German Offenlegungsschrift No. 25 27 370 discloses installation of a closure plate in a lower distribution pipe of a radiator also separating ascending from descending pipe pathways.

As will be described in greater detail hereinafter the system of the present invention provides a plurality of heat exchanger modules which are combinable to provide any selected number of modules, as desired.

Also, as is known, two types of heat exchangers exist; one being vertical and the other being horizontal. Such heat exchangers have proven to be efficient but are provided with a fixed amount of heat transfer surface. Therefore, when operating temperature requirements are changed, one heat exchanger is rendered obsolete and a new one designed to meet the new requirements must be installed. Further, if a heat exchanger becomes damaged, the entire unit must be removed for repairs, causing lengthy down time.

SUMMARY OF THE INVENTION

According to the invention, there is provided a modular heat exchanger system comprising at least a primary heat exchanger having two parallel manifolds with a chosen plurality of heat exchange tubes running therebetween, the manifolds defining a water pathway therein within which baffles are provided to produce a serpentine path through the manifolds and heat exchange tubes of the exchanger, one of the manifolds being an intake manifold and the other being a return manifold having a terminal return chamber, the chamber feeding into a return tube extending through the manifold and exiting the opposite end thereof, the tube being of smaller diameter than the manifold and creating an annular passageway therearound through which liquid flowing through the exchanger is routed.

DESCRIPTION OF THE PREFERRED EMBODIMENT

Figure 1:
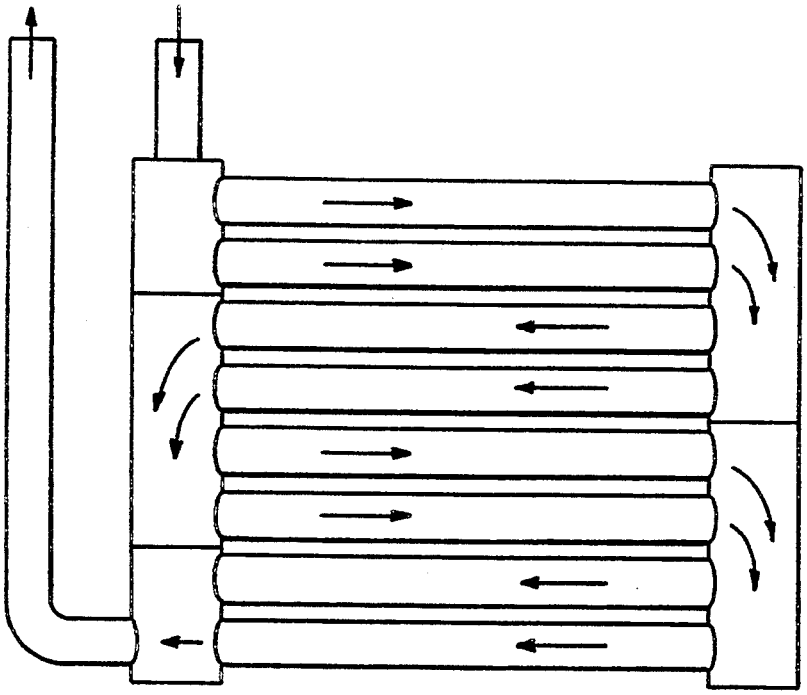
FIG. 1 PRIOR ART
FIG. 1 shows a prior art horizontal type heat exchanger.
Figure 2:
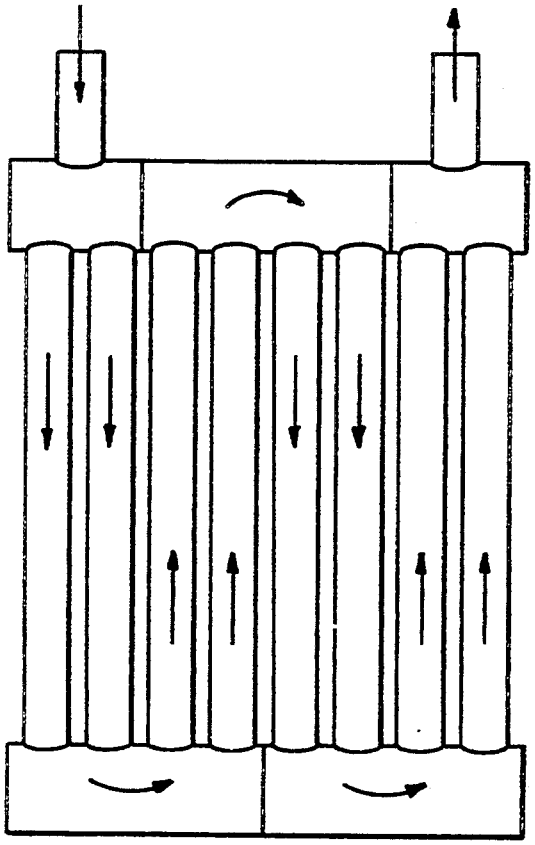
FIG. 2 shows a prior art vertical type heat exchanger.

Referring now to the drawings in greater detail, there are illustrated in FIGS. 1 and 2, respectively, a conventional horizontal heat exchanger and a conventional vertical heat exchanger.

As shown, each exchanger has a pair of parallel manifolds and a plurality of heat transfer tubes disposed between the manifolds in parallel relation with one another and with on end of each tube being engaged to one or the other of the manifolds.

An inlet tube is connected to one manifold for introducing a heating/cooling liquid into the heat exchanger and an outlet tube is connected to the other manifold for delivering the used liquid from the heat exchanger to other equipment.

The interior of each manifold is divided into a plurality of adjacent spaces along the length of the manifold by baffles. The heat transfer liquid introduced through the inlet tube flows in a serpentine pattern shown by arrows through the manifolds and heat transfer tubes to an outlet.

The horizontal type heat exchanger of FIG. 1 has a pair of vertical manifolds and a plurality of horizontal heat transfer tubes disposed therebetween. The inlet tube and the outlet tube are positioned parallel to the manifolds and perpendicular to the heat transfer tubes.

The vertical type heat exchanger of FIG. 2, on the other hand has a pair of horizontal manifolds and a plurality of vertical heat transfer tubes disposed between the manifolds. The inlet tube and the outlet tube are perpendicular to the manifolds and parallel to the heat transfer tubes.

Figure 3:
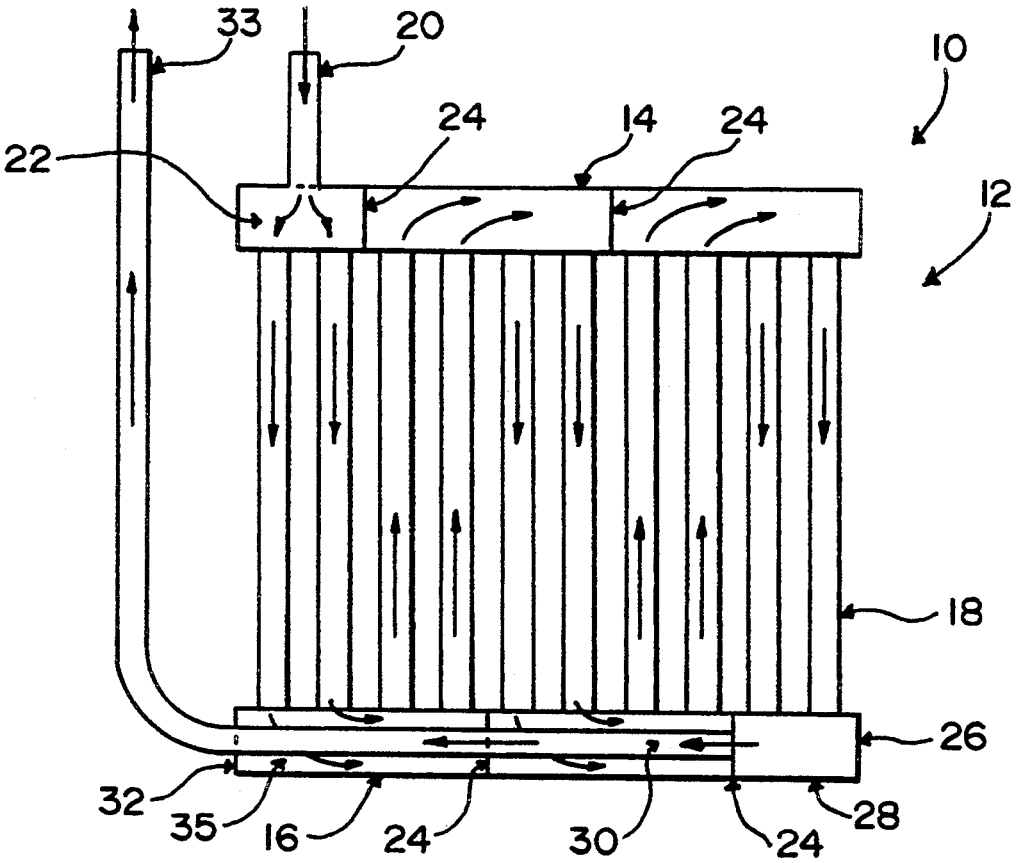
FIG. 3 is a cross sectional view through a primary horizontal heat exchanger of the system made in accordance with the teachings of the present invention.

Turning now to FIG. 3, there is illustrated therein a primary horizontal heat exchanger of the system 10 of the present invention which is generally identified by the reference numeral 12.

As shown, the heat exchanger 12 comprises a pair of parallel manifolds 14, 16 having a chosen plurality of heat transfer tubes 18 extending therebetween. An inlet tube 20 feeds fluid into one end 22 of manifold 14, with the inlet tube 20 being in line with the transfer tubes 18 and with fluid being forced into a first set of transfer tubes 18 as shown by the arrows, toward and into the other manifold 16. A serpentine path through the exchanger 12 is created by placing a series of baffles 24 within the manifolds 14 and 16, with the baffles 24 alternating in position from manifold 14 to manifold 16 to create the desired serpentine configuration.

Figure 4:
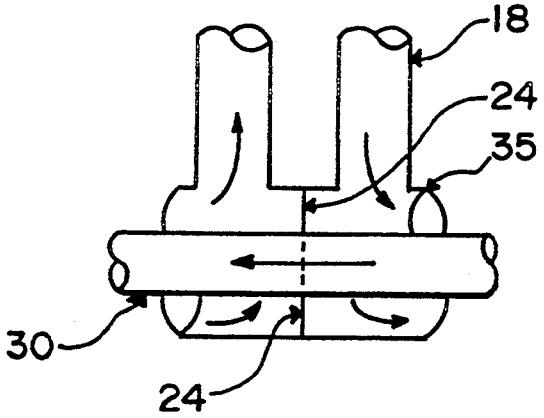
FIG. 4 is an enlarged view of a return line and baffle embedded within a manifold of the system of FIG. 3.
Figure 5:
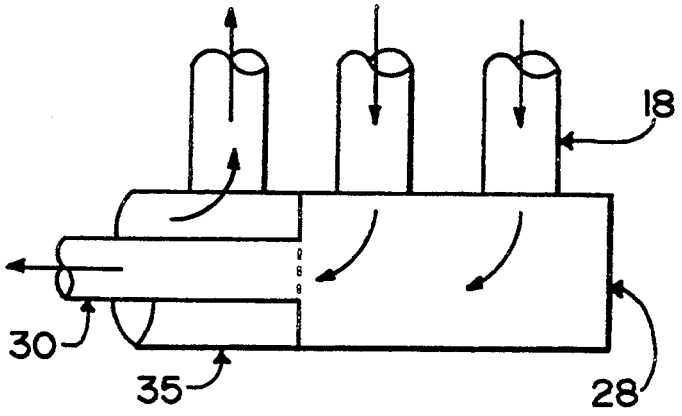
FIG. 5 is an enlarged view of a return chamber and its return line of the system of FIG. 3.

The manifold 16 here defines a secondary exit path therein for the fluid. In this respect, at one end 26 of the manifold 16 is defined a return chamber 28 from which an return tube 30 extends through the remainder of the manifold and exits therefrom at an opposite end 32 thereof terminating in an elongate end portion 33. The return tube 30 is of a diameter which is smaller than the diameter of the manifold 16, creating an annular liquid transfer channel 35 therearound through which fluid coursing between the transfer tubes 18 flows. These features are best illustrated in FIGS. 4 and 5.

Figure 6:
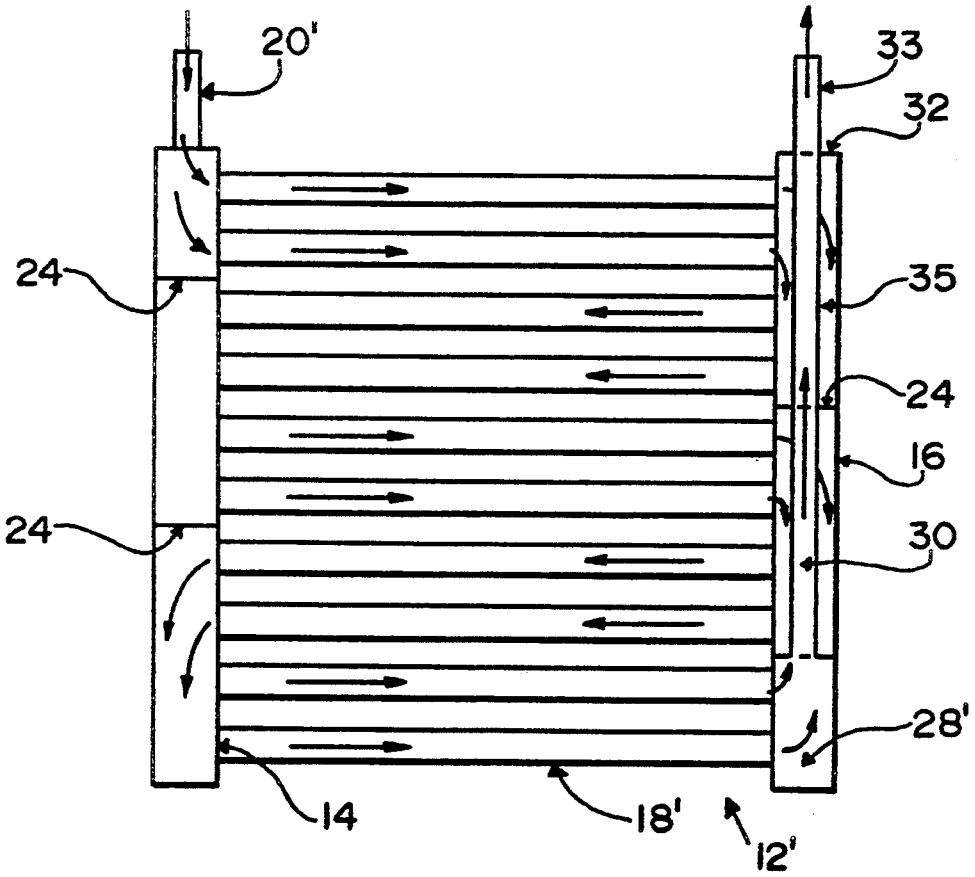
FIG. 6 is a cross sectional view through a primary vertical type heat exchanger of the system made in accordance with the teachings of the present invention.
Figure 7:
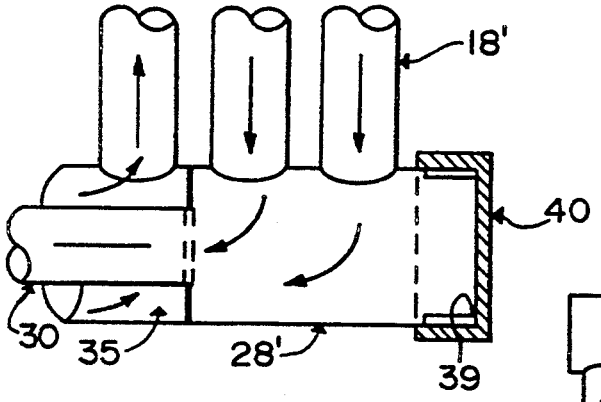
FIG. 7 is an enlarged view of a modified return chamber having an end cap thereon.

Turning now to FIGS. 6 and 7, there is shown therein a primary vertical heat exchanger 12' which is significantly similar in construction to the horizontal exchanger 12. Here, the difference lies in positioning of the inlet tube 20', with such inlet tube 20' now lying perpendicular to the transfer tubes 18' and in line with the manifold 14' rather than being in line with the transfer tubes 18'. Also, the need for an elongate exposed return tube end portion is eliminated in this embodiment.

To create a modular system 10 which is capable of being expanded, the return chamber 28' may be slightly extended and provided with an open end 39 over which a cap 40 can be secured in any acceptable manner, such as being threaded thereover.

By providing the open end 39 on the return chamber 28' of the primary heat exchanger 12, there is produced a capability for engagement thereto of a modular secondary heat exchanger 42 as desired.

Figure 8:
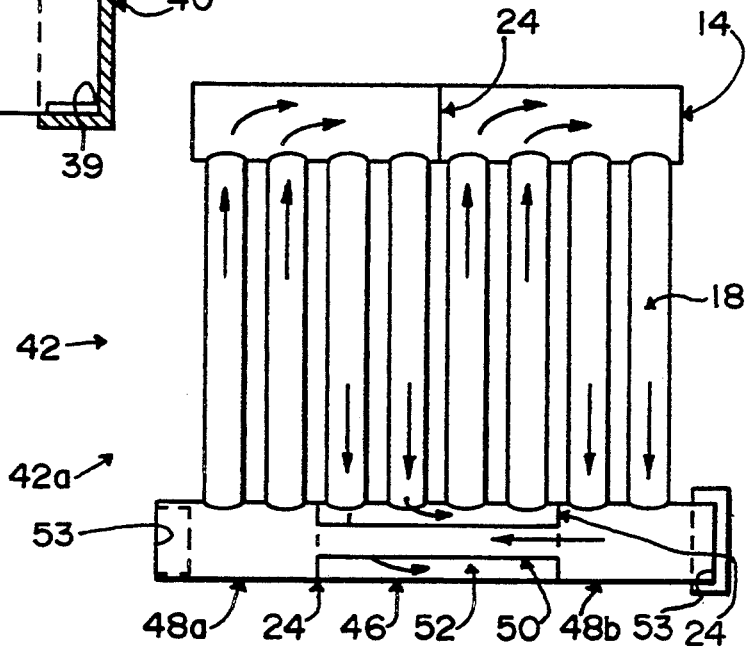
FIG. 8 is a cross section through an add on modular secondary horizontal heat exchanger of the system.
Figure 9:
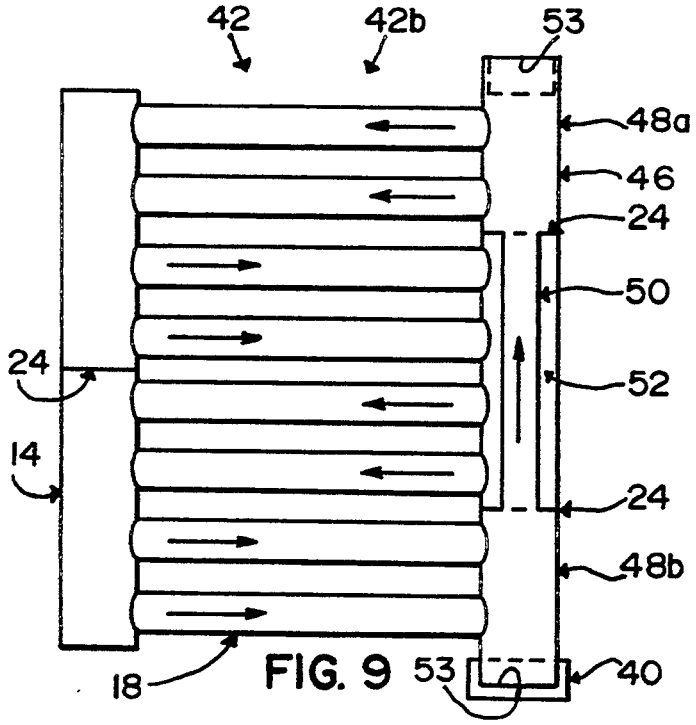
FIG. 9 is a cross section through an add on modular secondary vertical heat exchanger of the system.

Such secondary add on heat exchanger 42 is shown in FIGS. 8 and 9 where the secondary exchanger **42*a* shown in FIG. 8 is adapted for use with the horizontal system 10 and the secondary exchanger 42*b* shown in FIG. 9 is adapted for use with the vertical system 10**.

As illustrated, the secondary heat exchangers **42*a* and 42*b* are now provided with one manifold 46 having a chamber at each end thereof, with one chamber 48*a* serving as an inlet chamber 48*a* and the other chamber 48*b* acting as a return chamber 48*b*. Extending between the two chambers 48*a* and 48*b* is a return tube 50 which, again, is smaller in diameter than the manifold 46 channel creating an annular flow channel 52 therearound. A terminal end 53 of each chamber 48*a* and 48*b*** is open.

To create a continuation of the return tube 50 to extend same from the secondary exchanger 42 into communication with the return tube 30 in the primary exchanger 12 to which the secondary exchanger 42 will attach, a flow controlling connector is required. The connector may be a removable member **60*a* as illustrated in FIG. 10 or may be a permanent member 60*b* as illustrated in FIG. 11**.

In either, the connector must create a continuation of the return tube 50 while also providing an annular flow channel 52 therearound. Further, the connector 60 must have at least one end 62 which is seatable against an end wall 64 of the return chamber 28 in the primary exchanger 12 to seal off the entry to the return tube 30, creating fluid flow into the secondary exchanger 42 as shown in FIGS. 11–13.

Figure 10:
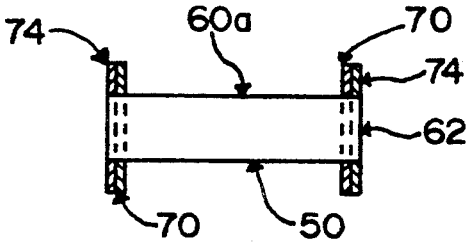
FIG. 10 is a longitudinal sectional view through a removable connector for joining a primary to a secondary heat exchanger.
Figure 11:
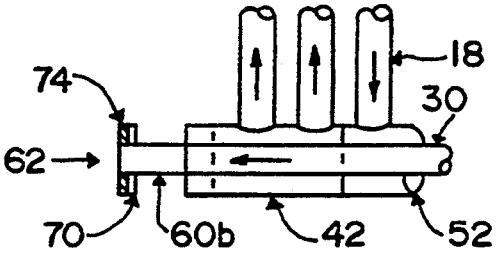
FIG. 11 is a cross section through a return tube including a permanent connector thereon.

This is best accomplished by the provision of the spool shaped removable connector **60*a* as shown in FIG. 10 or by the provision of a fixed connector 60*b* as shown in FIG. 11. It will be understood that the length of the connector 60*a* must be such as to allow for abutment of each end flange 70 thereof tightly against a corresponding return tube end 72. To ensure a fluid tight seal, an annular gasket 74 may be positioned between the end flange 70 and the end wall 64 of the return chamber 28**.

Figure 12:
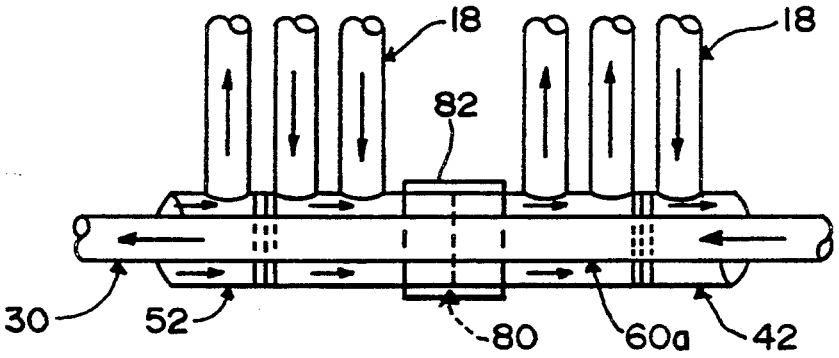
FIG. 12 is a cross sectional view showing a primary and a secondary heat exchanger joined together.
Figure 13:
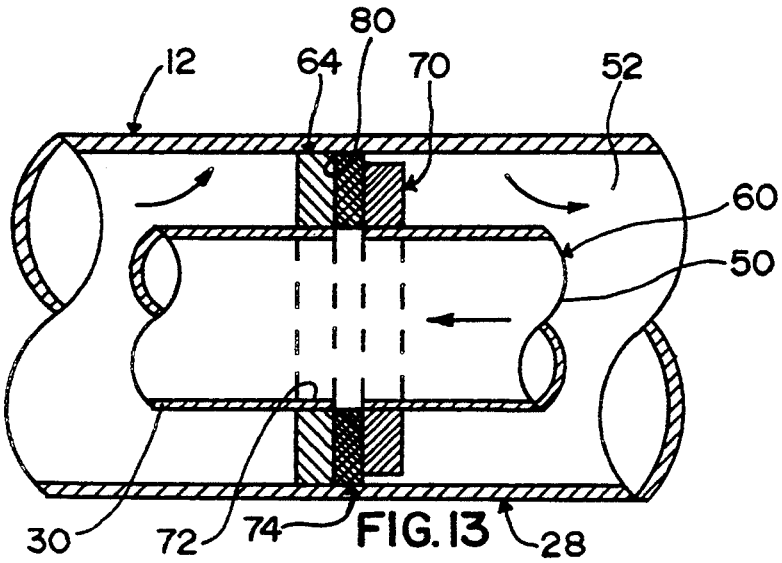
FIG. 13 is an enlarged view showing one end of a connector seated adjacent a return chamber wall in a return manifold of the system.

With the connector **60*a* in place, the fluid in the primary exchanger 12 is now shunted into the secondary exchanger 42 as shown in FIG. 12, rather than into return tube 30 until it reaches the return chamber 48*b* of the secondary exchanger 42. From there, it travels through the return tube 30, now extending all the way through the secondary and primary exchangers 42 and 12**, respectively.

The area of joining at 80 between the two exchangers 12 and 42 may be secured in any known manner, such as by securing a sleeve 82 therearound.

It will be understood that the chambers **48*a* and 48*b* of the manifold 46 in the secondary heat exchangers 42 are each open, to allow for add on of further exchangers 42 as desired and that the final return chamber 48*b*** may be capped off, as shown.

As described above, the system 10 of the present invention provides a number of advantages, some of which have been described above and others of which are inherent in the invention. Also, modifications may be proposed to the system 10 without departing from the teachings herein. Accordingly, the scope of the invention is only to be limited as necessitated by the accompanying claims.

I claim:

1. A modular heat exchanger system comprising at least a primary heat exchanger having two parallel manifolds with a chosen plurality of heat exchange tubes running therebetween, the manifolds defining a liquid pathway therein within which baffles are provided to produce a serpentine path through the manifolds and heat exchange tubes of the exchanger, one of the manifolds being an intake manifold and the other being a return manifold having a terminal return chamber, the chamber feeding into a return tube extending through the manifold and exiting the opposite end thereof, the tube being of smaller diameter than the manifold and creating an annular channel therearound through which liquid flowing through the exchanger is routed, said return chamber having a closable open end and the system further including a secondary heat exchanger having two parallel manifolds with a chosen plurality of heat exchange tubes running therebetween, the manifolds defining a liquid pathway therein within which baffles are provided to produce a serpentine path through the manifolds and heat exchange tubes of the exchanger, one of the manifolds being an intake manifold and the other being a return manifold having a closable open ended terminal return chamber, the chamber feeding into a return tube extending through the manifold and exiting the opposite end thereof, the tube being of smaller diameter than the manifold and creating an annular channel therearound through which liquid flowing through the exchanger is routed, and an intake chamber at the opposite end of the manifold which is joined to the return chamber of the primary exchanger, in a manner where, upon blocking access between the return tube and return chamber of the primary exchanger, liquid from the return chamber of the primary exchanger flows into the intake chamber of the secondary exchanger, with access between the return chamber and return tube in the primary exchanger being blocked by a spool shaped flow connector comprising a small diameter tube having two end flanges, one of which seats within the return chamber of the primary exchanger and lies against the baffle defining the chamber and the other end of which rests within the intake chamber of the secondary exchanger and seats against the baffle defining same.

* * * * *